United States Patent [19]

Ashley et al.

[11] Patent Number: 4,665,722

[45] Date of Patent: May 19, 1987

[54] DYE SPRING PROTECTION SYSTEM

[75] Inventors: Fred C. Ashley, Columbus, N.C.; Robert W. McCullough, Spartanburg, S.C.

[73] Assignee: Milliken Research Corporation, Spartanburg, S.C.

[21] Appl. No.: 782,038

[22] Filed: Sep. 30, 1985

[51] Int. Cl.[4] ..... D06B 23/04

[52] U.S. Cl. ..... 68/198; 242/118.1

[58] Field of Search ..... 68/198, 212; 242/118.1, 242/118.11, 118.2

[56] References Cited

U.S. PATENT DOCUMENTS

| | | | |
|---|---|---|---|
| 1,928,251 | 9/1933 | Gollong | 68/198 |
| 1,928,252 | 9/1933 | Gollong | 68/198 |
| 2,007,914 | 7/1935 | Elling | 68/198 |
| 2,089,962 | 8/1937 | Huttinger | 68/198 X |
| 3,253,436 | 5/1966 | Soltis | 68/198 |
| 3,433,432 | 3/1969 | Willis | 242/118.1 |

FOREIGN PATENT DOCUMENTS

| | | | |
|---|---|---|---|
| 371693 | 4/1932 | United Kingdom | 68/198 |

*Primary Examiner*—Philip R. Coe

*Attorney, Agent, or Firm*—Earle R. Marden; H. William Petry

[57] ABSTRACT

Dye spring protection system which employs a substantially circular member between each yarn package being dyed and allows the dye packages to abut one another but at the same time protects the ends of the dye spring. The dye spring protector has an internal groove therein to accommodate the top and bottom of a dye spring during dyeing of yarn wound on the spring.

1 Claim, 8 Drawing Figures

DYE SPRING PROTECTION SYSTEM

This invention relates generally to the package dyeing of yarn and in particular to the use of a dye spring protector on the ends of a dye package, which protects the yarn being dyed, provides a seal between adjacent yarn packages and maintains correct spacing and alignment between wound packages and the dye carrier spindle.

It is therefore an object of the invention to provide a system which protects the yarn, wound on a dye spring for dyeing, during and after the dyeing thereof and maintain package and spindle alignment.

There are a number of ways to provide a dyed fabric. One way is to form the fabric from undyed yarn and then dye the fabric as either piece goods or in roll form. Another way to dye fabric is dye the yarn prior to forming into fabric so that when the yarn is knit, woven, etc. the formed fabric will have the desired color. The herein described invention is directed to the dyeing of yarn on a package prior to fabric forming and, in particular, is directed to a yarn package which can be delivered directly to the fabric forming machine without backwinding of the yarn.

Other objects and advantages of the invention will become readily apparent as the specification proceeds to describe the invention with reference to the accompanying drawings in which.

It has been found that in the dyeing of yarn in package form, the plastic dye springs tend to get distorted on the ends due to heat and pressure causing various problems with the yarn package when it is taken directly to the fabric forming machine, such as a knitting machine. The yarn ends become distorted causing roll in and sloughing of the yarn as well as trapping the yarn in the package. These problems, as well as others, have been substantially reduced by the herein disclosed dye spring protection system.

Figure 1:
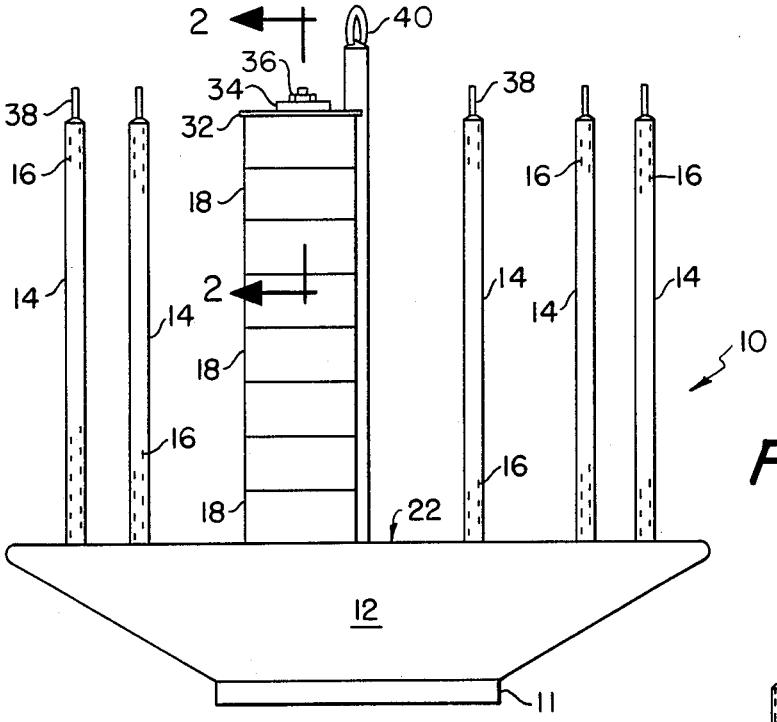
FIG. 1 is a side view of a dye package carrier support frame.

Looking now to the drawings, FIG. 1 shows a typical yarn package support carrier 10 which is inserted in a pressure dye beck over the dye bath with the flange 11 mating with the dye bath opening so that dye can be pumped into chamber 12 and subsequently up into the spindles 14 and out through the openings 16 into the yarn packages 18. The dye passes through the packages 18 and is recirculated to the chamber 12 for further use.

Figure 2:
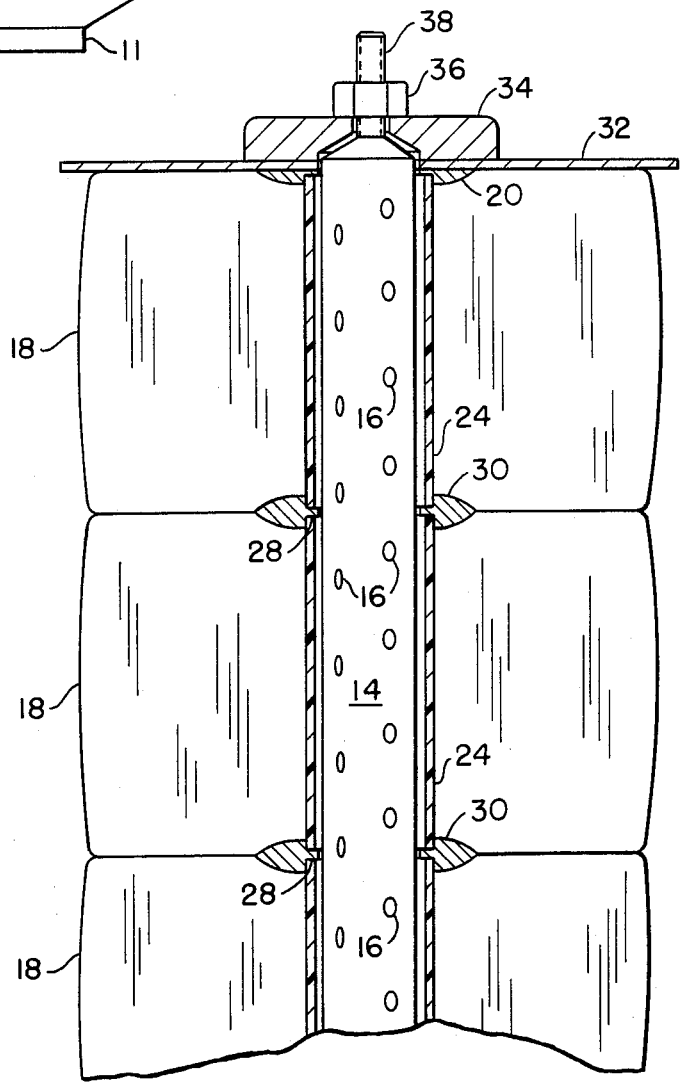
FIG. 2 is a cross-sectional view of a portion of one stack of dye packages on a dye spindle taken on line 2—2 of FIG. 1.

In FIG. 1, packages 18 are shown loaded on only one spindle 14 for purposes of illustration and description. In loading the dye package carrier 10 the operator places a flat dye spring protector 20, such as that shown in FIG. 2, over the spindle 14 so that the flat side abuts the bottom surface 22 of the carrier 10. Then a wound yarn package 18 is placed on the dye spindle 14 and drops on the curved surface of the dye spring protector 20. Since the yarn on the package does not extend all the way out to the end of the dye spring 24, the end of the dye spring will telescope within the circular groove 26 of the dye spring protector and abut the circular flange 28. Then a full dye spring protector 30, as shown in detail in FIG. 3 and 4, will be dropped over the spindle 14 and its groove 26 will telescope over the other end of the dye spring 24. Then another package 18 will be dropped onto the second dye spring protector in the same manner. Since the package 18 will be compressed to form the arrangement shown in FIG. 1 and 2, a hollow extension (not shown) is placed over the top of the spindle 14 and the desired number of packages 18 with protectors 30 therebetween will be telescoped thereover. When the desired number of packages have telescoped into place, the dye spring protector 20 is placed on the top package 18, with its flat surface up, to contact a flat end plate 32 placed on top of the column of packages. Then a hydraulic, hollow ram is actuated against the plate 32 to compress the packages 18 and push the plate 30 downward. When the plate 30 has been forced downwardly to the position shown in FIGS. 1 and 2, an end cap 34 is placed on top thereof and secured in position by a nut 36 screwed onto the threaded projection 38 of the spindle 14. After all the desired spindles 14 on a carrier 10 are loaded in the manner aforedescribed, the carrier is picked up by a crane with a hook engaging the eyelet 40 and carried to the dye kettle wherein the packages 14 are dyed.

Figure 5:
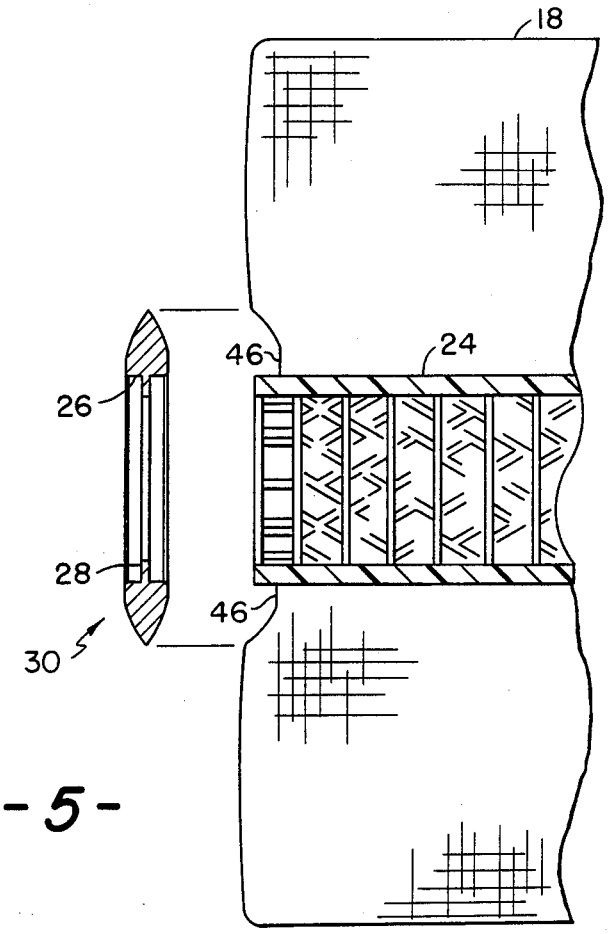
FIG. 5 is partial cross-sectional view of a dye package after dyeing showing the protector ring removed.

Looking now to FIG. 5, the end of the package 18 is shown after it has been compressed and dyed and the dye spring protector 30 removed to show the end of the package around the dye spring 24. In the preferred form of the invention, the dye spring 24 is plastic and is compressed upon loading of the dye package carrier 18. In FIG. 5, it can be seen that the dye spring protector 30 prevents the end of the dye spring 30 from being distorted during dyeing and prevents the yarn from being forced outwardly over the end of the dye spring 24.

Figure 3:
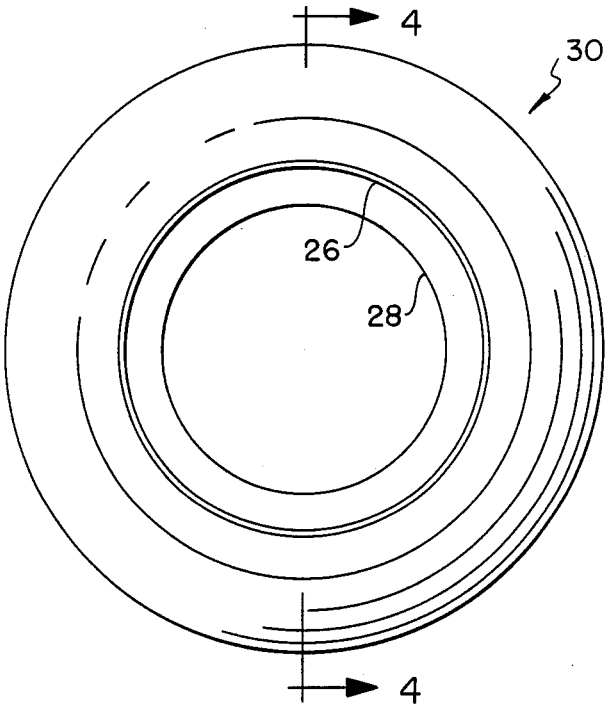
FIG. 3 is a top view of the new and improved dye package protector ring.
Figure 4:
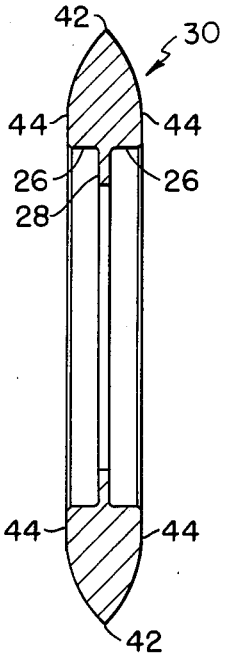
FIG. 4 is a cross-sectional view taken on line 4—4 of FIG. 3.

Looking now to FIGS. 3 and 4, the dye spring protector 30 is shown in detail. In the preferred form of the invention, the protector 30 is made from stainless steel but it is within the scope of the invention to form it from other suitable materials such as plastic and/or other similar materials. The protector 30 is circular in shape and converges at the ends 42 to a sharply rounded edge. Between the ends 42 and the circular groove 26 are flat body portions 44 to form the flat end portions 46 of the dye yarn package. As discussed previously, a circular flange 28 is provided internally to provide an abutment for proper spacing of the top and bottom of the dye spring 24 to dye spindle 14.

Figure 6:
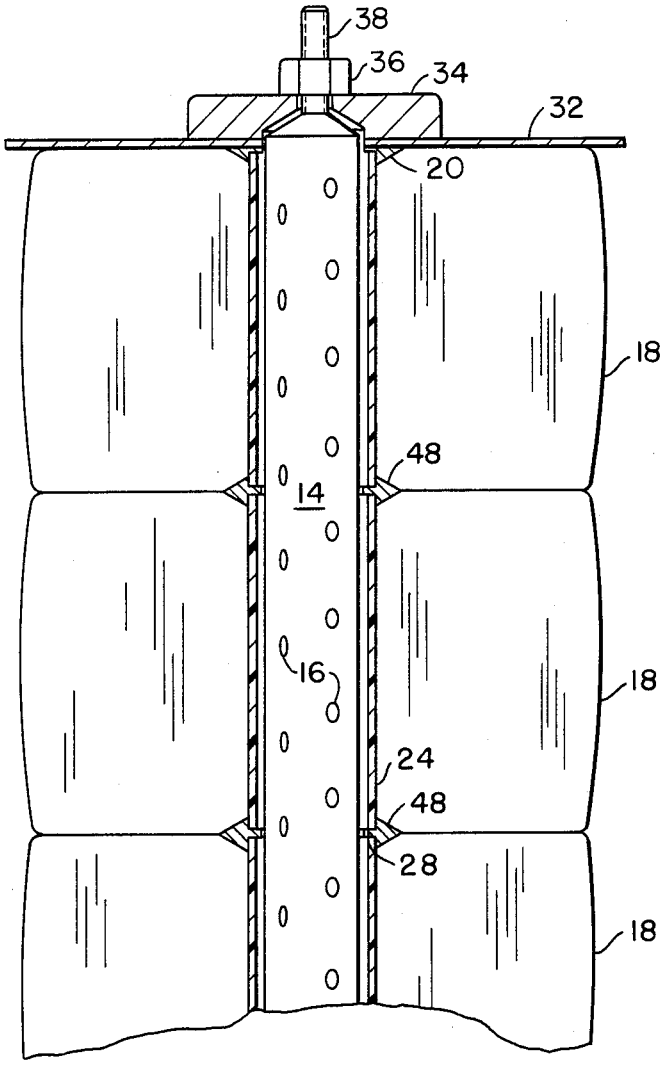
FIGS. 6–8 are the same as views 2–4, respectively showing a modified dye spring protector ring.
Figure 7:
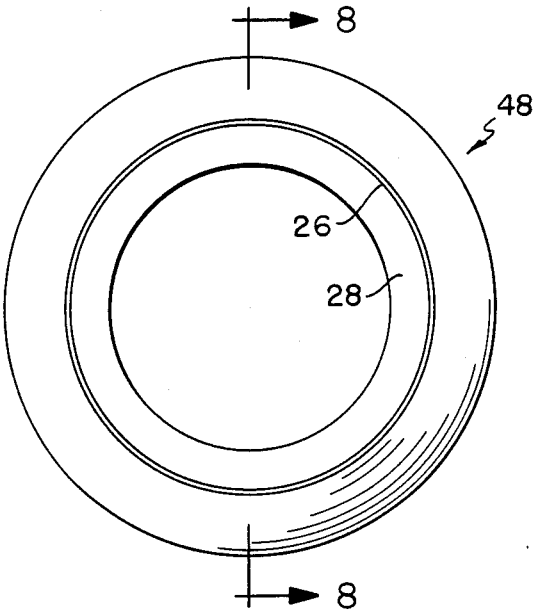
Figure 8:
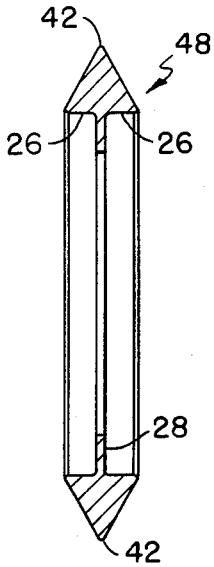

FIGS. 6–8 illustrate the use of a more compact dye spring protector 48 which accomplishes the same basic operation as the dye spring protector 30 of FIG. 1–5 except it is smaller in diameter, cheaper to manufacture and is more compact when located within the confines of the compressed yarn package. Basically the dye spring protector 48 eliminates the flat portions 44 of the dye spring protector 30.

The herein disclosed dye spring protection system provides numerous advantages. Even though the herein disclosed dye spring protector works well on all types of dye springs and various yarns, it is especially beneficial for plastic dye springs since it protects the dye springs during dyeing of the yarn reducing waste carried by distorted, damaged dye springs and dye tubes.

The dye protector does not take up space between the yarn packages thereby providing a seal between the packages to improve the dyeing quality of the yarn and, at the same time, forms the yarn at the ends of the dye spring to prevent rolling or trapping of the yarn. This forming of the yarn during dyeing also helps to hold and protect the transfer tail while protecting the yarn during shipment since the yarn no longer projects out to the end of the dye spring.

Although we have described in detail the preferred embodiments of the invention, it is contemplated that many changes may be made without departing from the scope or spirit of the invention, and we desire to be limited only by the claim.

We claim:

1. A dye package carrier for the dyeing of yarn in package form comprising: a support plate, a plurality of spindles projecting upwardly therefrom, a plurality of yarn packages telescoped over said spindles, each of said yarn packages being wound on a collapsible dye spring, a dye spring protector located between adjacent packages on said spindles, said protecting being substantially circular and converging to a rounded edge at the circumference thereof, said dye spring protector having a groove therein in the top and bottom thereof accommodating the bottom of the dye spring of one package and the top of the dye spring of the next adjacent package, said dye spring protector having a flange therein projecting inwardly and separating the top and bottom grooves and means operably associated with the top package on each spring to compress the packages on each spindle to cause adjacent packages to abut one another and force said dye spring protector into the side of each yarn package to force the yarn away from both ends of the respective dye springs, each of said dye spring protectors tapering to a point from a point adjacent to said top and bottom groove.

* * * * *